US005775228A

United States Patent [19]

Lamba et al.

[11] Patent Number: 5,775,228

[45] Date of Patent: Jul. 7, 1998

[54] LOCOMOTIVE ADHESION ENHANCING SLIPPING DISCS

[75] Inventors: Harinder Singh Lamba, Downers Grove; Robert Thomas Scott, Lockport; Xiaoying Sean Ma, Chicago, all of Ill.

[73] Assignee: General Motors Corporation, Detroit, Mich.

[21] Appl. No.: 843,320

[22] Filed: Apr. 14, 1997

[51] Int. Cl.[6] ..... B61C 15/00

[52] U.S. Cl. ..... 105/73; 104/279; 15/55

[58] Field of Search ..... 105/73; 104/279; 291/2, 3; 15/21.1, 54, 55

[56] References Cited

U.S. PATENT DOCUMENTS

| | | | |
|---|---|---|---|
| 3,004,273 | 10/1961 | Rushmer | 104/279 |
| 4,781,121 | 11/1988 | Sudhir et al. | 104/279 |
| 5,054,401 | 10/1991 | Lindholm | 104/279 |
| 5,060,335 | 10/1991 | Webster | 104/279 |
| 5,437,233 | 8/1995 | Richter | 104/279 |

OTHER PUBLICATIONS

"Development a New Method for Adhesion Improvement Replacing Traditional Sanding" Kaoru Ohno and Takumi Ban, pp. 1–6 Presented at the 1994 Mini–Conference of the International Heavy Haul Association, Omaha, Nebraska, Jun. 5–10, 1994.

*Primary Examiner*—S. Joseph Morano
*Attorney, Agent, or Firm*—Michael J. Bridges

[57] ABSTRACT

At least one powered disc is suspended from a locomotive and applied to a rail surface for treating the rail surface ahead of driven locomotive wheels to increase adhesion between the driven wheels and the rail surface. Torque applied to the disc varies the rate of rotation of the disc away from that of a freely-rotating disc so that a significant level of creep may be maintained between the disc and the rail surface with substantially no angle of attack between the disc and the longitudinal axis of the rail. The torque may be generated through a second disc contacting the rail and coupled to the first disc with the first and second discs rotating with differing rates of rotation, or may be generated through a passive or active actuator coupled directly to the disc. The amount of creep between the disc and the rail surface and the direction of the creep may be varied in accordance with the level of contamination of the rail and the disc may be disengaged from the rail when cleaning is not required.

5 Claims, 4 Drawing Sheets

LOCOMOTIVE ADHESION ENHANCING SLIPPING DISCS

TECHNICAL FIELD

This invention relates to locomotive adhesion enhancement and, more particularly, to an on-board slipping disc applicator system.

BACKGROUND OF THE INVENTION

The tractive force of a locomotive depends directly on the level of adhesion between the driven wheels of the locomotive and the rail. Gains made in locomotive powerplant output and in drive efficiency remain significantly mitigated by low adhesion between the driven wheels and the rail. Contaminants on the rail surface significantly reduce adhesion. Unpowered cars may include apparatus for depositing a lubricant on the rail to reduce their rolling resistance. The lubricant also serves to reduce the adhesion of tractive units following such unpowered cars. Such lubricants are in widespread use today.

Proposals have been made to minimize the deleterious effect that rail contaminants, including residue of rail lubricants, have on tractive unit adhesion. Rail treatment proposals include delivery systems for depositing sand or adhesion enhancing powders on the rail ahead of the driven wheels of the tractive units. Such powders include the compositions of copending U.S. patent application Ser. No. 08/794,160, filed Feb. 3, 1997, attorney docket number H-197067, assigned to the assignee of this application and incorporated herein by reference. Such proposals have provided some adhesion improvement. However, sand at the wheel-rail interface significantly increases both wheel and rail wear, adding significantly to maintenance costs. Additionally, the substantial volume of the sand or powder that must be hauled with the tractive unit reduces its capacity to transport cargo.

It has also been proposed in U.S. Pat. No. 4,781,121 to treat the rail through application of a series of undriven (freely rotating) discs to the rail with the discs having an alternative angle of attack (angle relative to the direction of motion of the locomotive). If the discs are aligned with the rail (zero angle of attack) then they rotate with no creep relative to the rail and provide virtually no adhesion enhancement. Creep of such a disc may be defined as follows:

$$\text{Creep}=(\text{disc speed}-\text{locomotive speed})/\text{locomotive speed}$$

in which the disc speed is the rate of rotation of the disc expressed in units of equivalent miles (or kilometers) per hour, and locomotive speed is expressed in units of miles (or kilometers) per hour. In has been determined that only when creep is present between the disc and the rail will there be any significant rail treatment and corresponding adhesion enhancement. A small degree of creep is produced in this prior art approach when the discs are not aligned with the rail (non-zero angle of attack). However, the angled discs and the relatively small amount of induced creep have been demonstrated to merely redistribute contaminants about the rail surface without removing the contaminants altogether, resulting in little adhesion improvement.

A further prior art adhesion enhancing approach combines slip of the locomotive driven wheels with application of sand to the rail in front of said wheels. More specifically, when the driven wheels are determined to be slipping, sand is applied to the rail and the combination of the slipping wheels and the sand provides for some cleaning of the rail and some adhesion enhancement. However, the locomotive control system generally operates to minimize slip and may modulate output power in response to a condition of wheel slip until the slip condition is substantially eliminated. The modulation of output power may compromise locomotive tractive force and reduce performance. When the slip condition is relieved, further cleaning of the rail may not be provided under such prior art approach, such that the locomotive is required to operate under low adhesion conditions, further reducing performance.

It would therefore be desirable to significantly increase adhesion of driven locomotive wheels to increase locomotive tractive force.

SUMMARY OF THE INVENTION

The present invention is directed to an on-board slipping disc applicator apparatus for significantly enhancing adhesion at the wheel-rail interface.

More specifically, at least one powered disc is provided in front of each lead driven locomotive wheel in position to contact the rail surface and powered so as to maintain a predetermined degree of slip between the disc and the rail for consistent cleaning of the rail. The slip may be positive or negative, and may vary as a function of operating conditions including the condition of the rail. In accord with a further aspect of this invention, the discs are aligned with the rail, providing for substantially zero angle of attack therebetween on straight stretches of rail, for maximum treatment of the rail surface.

In accord with a further aspect of this invention, a plurality of discs are provided in front of each lead driven locomotive wheel and are aligned with the corresponding wheel with substantially zero angle of attack relative to the rail. The discs are powered in such a manner that the creep of neighboring discs alternates in sign. Still further, the discs may be completely disengaged from the rail when not needed to reduce locomotive rolling resistance. In accord with a further aspect of this invention, sand or other compositions including the compositions of copending U.S. patent application Ser. No. 08/794,160, filed Feb. 3, 1997, assigned to the assignee of this application and incorporated herein by reference may be deposited on the rail just ahead of the slipping discs for more comprehensive rail cleaning and further increase in adhesion.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
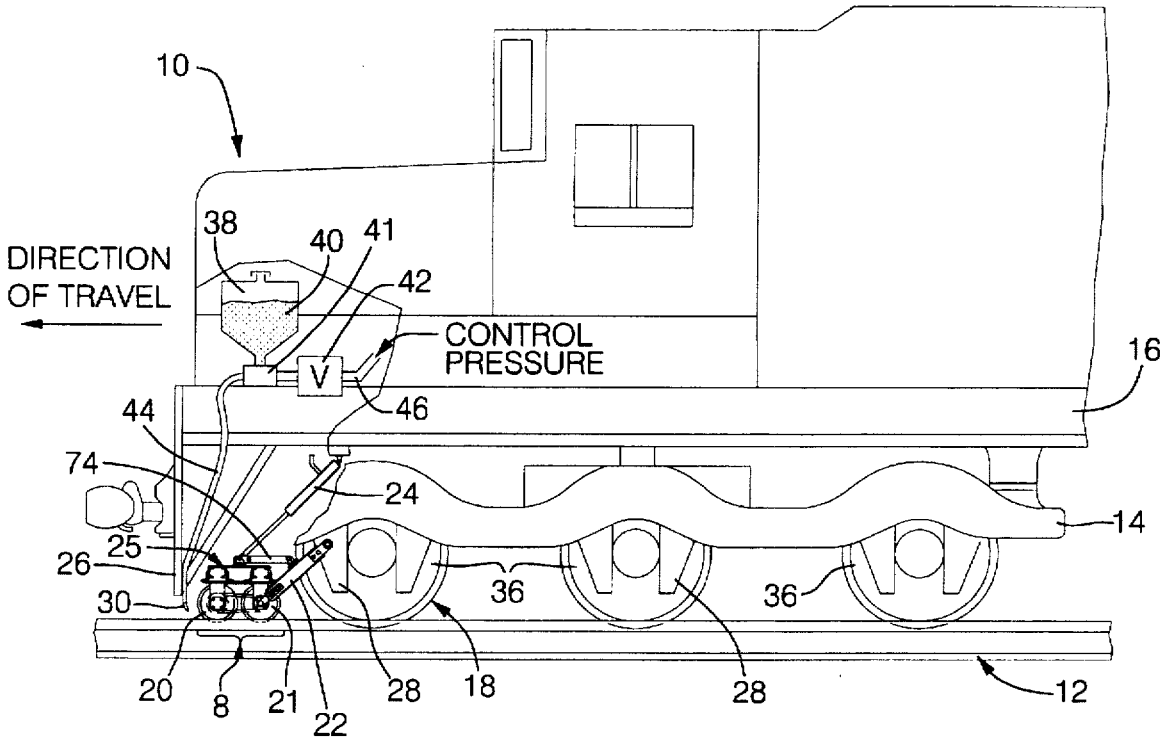
FIG. 1 is a side view of a front locomotive end slowing the general location of the slipping disc applicator assembly of the preferred embodiment of this invention.

Referring to FIG. 1, the front (cab) end of a locomotive 10 is supported by underframe structure 16 residing on truck (also referred to as bogie) 14 having a plurality of wheels 36 of a conventional design at least one pair 18 of which are driven, the wheels riding on a rail 12. Located ahead of the forward pair of driven wheels 18 on both the left and right sides of the locomotive is a slipping disc assembly, only the slipping disc assembly 8 of the left side of the locomotive 10 being shown for brevity. The slipping disc assembly includes a positioning assembly which includes a suspension assembly and a positioning mechanism generally comprising elements 22, 24, 25, 66, 68, and 74, to be described. The slipping disc assembly of the right side of the locomotive is substantially a "mirror-image" of the assembly 8 of the left side of the locomotive of FIG. 1 and is connected to the assembly 8 through a secure connection to a header 25. The slipping disc assembly 8 includes front and rear hardened, flanged metallic discs 20 and 21, respectively. A ball-jointed or spherical bearing linked lever 22 is connected between the assembly 8, such as at a central position of the rear disc 21, and the bearing adapter 28 of wheel 18 to stabilize the position of the assembly 8. A support link 74 is connected between a header 25 of the assembly 8 and an intermediate position along the lever 22, with a pneumatic cylinder 24 vertically extending from the header 25 to a fixed position on the underframe structure 16. The pneumatic cylinder 24 is controlled to raise and lower the assembly 8 and for applying downward pressure on the assembly 8 to ensure robust engagement of the discs 20 and 21 with the rail 12. A frontal plate 26 extends laterally across the bow of the locomotive, with the slipping disc assembly 8 of the right and left side of the locomotive adjacent thereto. The lever 22 is attached to bearing adapted 28 of the bogie 14, interacts with the pneumatic cylinder 24, header 25, and flanged discs 20 and 21 to maintain the overall assembly 8 in stable position relative to the rail 12.

A delivery system for depositing an adhesion enhancing composition on the rail of both sides of the locomotive slightly forward of the slipping disc assembly 8 terminates in a standard tapered nozzle 30 directed generally in the direction of the point of contact between the rail 12 and the forward disc 20. A delivery system for application of an adhesion enhancing composition, such as sand or the composition of copending U.S. application Ser. No. 08/794,160, filed Feb. 3, 1997, hereby incorporated herein by reference and assigned to the assignee of this application is included in this embodiment. Such delivery system comprises a volume of the composition 40 of the incorporated reference gravity fed through a reservoir 38 to a reservoir outlet 41 and into supply line 44 into which is driven any suitable fluid such as air or water under pressure from an inlet line 46. A standard valve V 42, such as of the solenoid type is positioned in the inlet line 46 to control application of the pressurized fluid to the outlet 41 of the reservoir to drive the composition through the supply line 44 under pressure and out the tapered nozzle 30 to the disc-rail interface. The supply line 44 and nozzle 30 may take any standard form, secured to the truck 14 (FIG. 1). The valve V 42 may be an electrically controlled solenoid valve of any suitable commercially available type that is normally closed. Standard valve control circuitry (not shown) is provided to selectively drive the valve V 42 to an open position in response to detected slip conditions between the rail 12 and the driven wheels 36 to allow the composition 40 to flow under pressure through the supply line 44 and nozzle 30. Slip conditions may be detected through any generally known detection procedure. It should be pointed out that the composition delivery system of this embodiment is but one approach for delivering the composition 40. Other generally-known delivery systems may be provided for such delivery, through the exercise of ordinary skill in the art to which this invention pertains.

Figure 2:
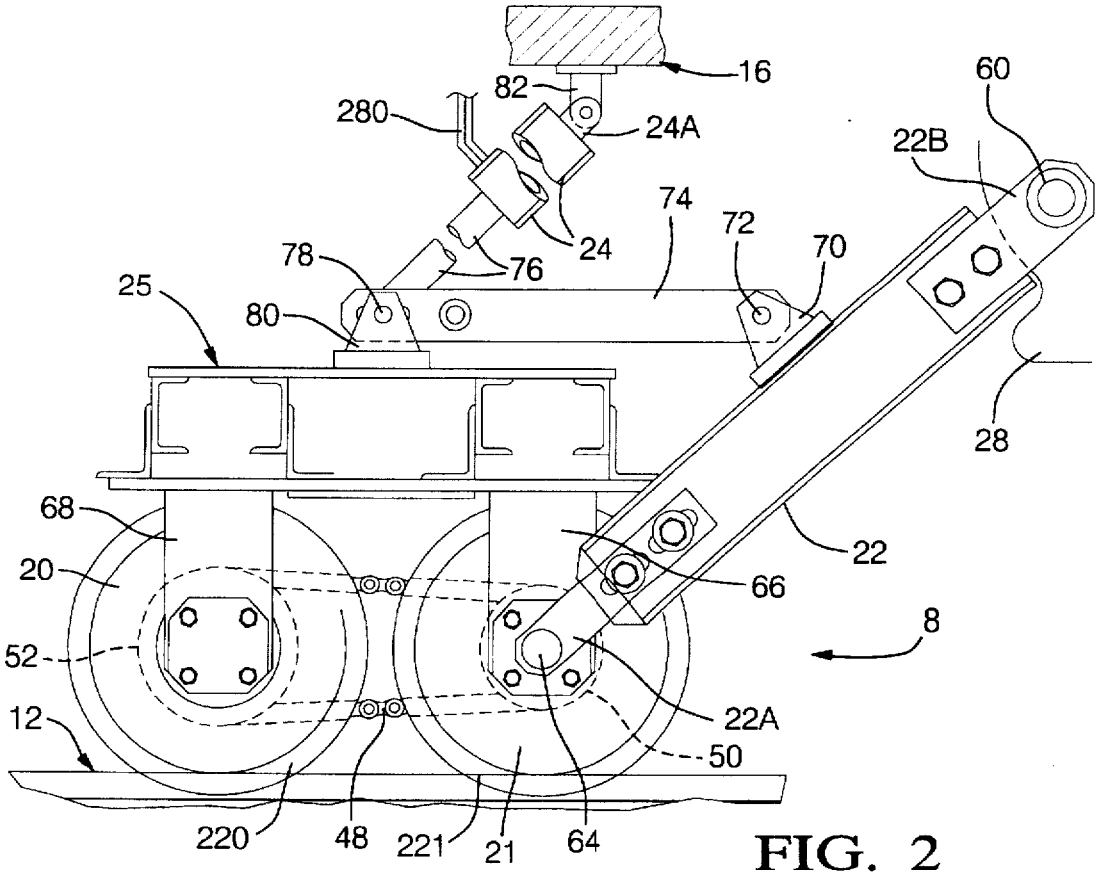
FIG. 2 is an enlarged view of the slipping disc applicator assembly installation of FIG. 1.

Referring to FIG. 2, slipping disc assembly 8 has front disc 20 and rear disc 21 mechanically coupled by chain or belt 48 to co-rotate and be positioned in the assembly 8 so that both discs, when lowered in an engaged position, consistently contact rail 12. Disc 20 includes an interior flange 220 and disc 21 includes an interior flange 221. Sprockets 50 and 52 are secured to respective discs 21 and 20 and include spaced teeth for securely meshing with slots in the chain 48 to prevent substantial slip between the chain and the sprockets. The sprockets 52 and 50 may be bolted or welded in a centered position on the discs 20 and 21. Creep is induced between at least one of the discs and the rail 12 through translation of tangential disc-rail contact forces into unbalanced opposing rotational force on the chain 48 via sprockets 50 and 52 of substantially differing radius. For example, in this embodiment, the radius of sprocket 52 is about 3.82 inches, and the radius of sprocket 50 is about 2.39 inches. Sprocket 52 has sixteen teeth spaced about its circumference and sprocket 50 has ten teeth spaced about its circumference. Under normal operating conditions, disc 20 will rotate with negative creep (slower than a free-rolling rate of rotation), and disc 21 will rotate with positive creep (faster than a free-rolling rate of rotation), driven by the net rotational force on chain 48, providing for a cleaning action on the rail. On substantially straight stretches of rail, the angle of attack of the discs 20 and 21 will be zero yet beneficial creep will be induced between the discs and the rail 12. The amount of creep may be, within limits, adjusted by varying the ratio of the radii of the discs, with a larger ratio providing for greater net rotational force on chain 48 and increased levels of creep in the discs 20 and 21.

Disc 20 is attached to header 25 through vertical link 68 bolted to the disc 20. Likewise, disc 21 is attached to header 25 through vertical link 66 bolted to the disc 21. The header maintains discs 20 and 21 in substantially constant relative position and provides for substantially constant relative elevation between the slipping disc assemblies on the left and right sides of the locomotive 10. Connection head 80, such as in the form of a clevis, is secured on an upper surface 246 of the header 25 in an upward orientation with support link 74 attached thereto such as in the form of a clevis and pin joint or any rotational joint whereby support link maintains a rotational degree of freedom substantially in parallel to the rotational degree of freedom of the discs 20 and 21. The support link 74 extends to and attaches to connection point 70 which may be in the form of a clevis which is secured in an intermediate position along the lever 22, forming a rotational joint between the joint 70 and the support link 74, for example of the clevis and pin type or any conventional rotational joint providing a degree of freedom in parallel to the joint formed between support link 74 and clevis 80.

Lever 22 is bolted on a first end **22*a* to a center hub 64 of disc 21 with two spherical bearings (not shown) and is bolted on a second end 22*b* opposing the first end 22*a* to truck bearing adapter 28 of wheel 18 of PIG. 1. The lever is, in this embodiment, attached to the truck bearing adapter 28 with a spherical bearing 60 providing for a rotational joint between the second end 22*b* and the adapter 28 and another spherical bearing 64 providing for a rotational joint between the first end 22*a* and the hub of disc 21. The assembly 8, including the discs 20 and 21 and described elements 66, 68, 25, 74 may be bi-directionally displaced along a direction normal to the rail 12. The assembly 8** is illustrated in FIGS.

1 and 2 in a lowered position for consistent contact of the discs 20 and 21 with the rail. However, the assembly may be raised or lowered depending on operating conditions. More specifically, if rail cleaning requirements mandate a lowering of the assembly 8, for example to maintain contact between the discs 20 and 21 and the rail or to increase disc pressure on the rail 12, the assembly may be lowered. Alternatively, if the operating conditions do not require treatment of the rail for enhanced adhesion, the assembly 8 may be raised so that no contact between the discs 20 and 21 and the rail 12 is made, as may provide for increased tractive efficiency. The described slip detection system to which the valve V 42 is responsive in FIG. 1, providing for delivery of the composition 40 through the nozzle 30 may be used as a condition for applying the assembly of FIG. 2 to the rail 12.

The mechanism for raising and lowering the assembly 8 may be any conventional actuator device, such as the pneumatic cylinder 24 coupled, at an upper end 24*a* to a connection point which may take the form of a clevis, in a rotational clevis and pin joint 82 secured to the underframe structure 16. A piston 76 reciprocates within the cylinder 24 and extends from the lower end of the cylinder 24 terminating in a connection point on the upper surface 246 of header 25, for example in a position laterally offset from the described joint formed between support link 74, connection point 80 and spherical bearings 78. A pair of pneumatic control lines 280 are provided from an air supply to the cylinder through two corresponding solenoid valves (not shown) one solenoid valve being normally open and the other normally closed, with pneumatic pressure increased in the cylinder 24 via a first of the supply lines 280 and relieved in the cylinder 24 via a second of the supply lines through a standard pressure regulator mechanism (not shown), as is generally understood in the art. The pressure regulator may be electronically controlled to raise and lower the assembly 8 and to vary the degree of downward force applied to the assembly 8 to maintain consistent contact between the discs 20 and 21 and the rail 12 in any suitable manner.

Figure 3:
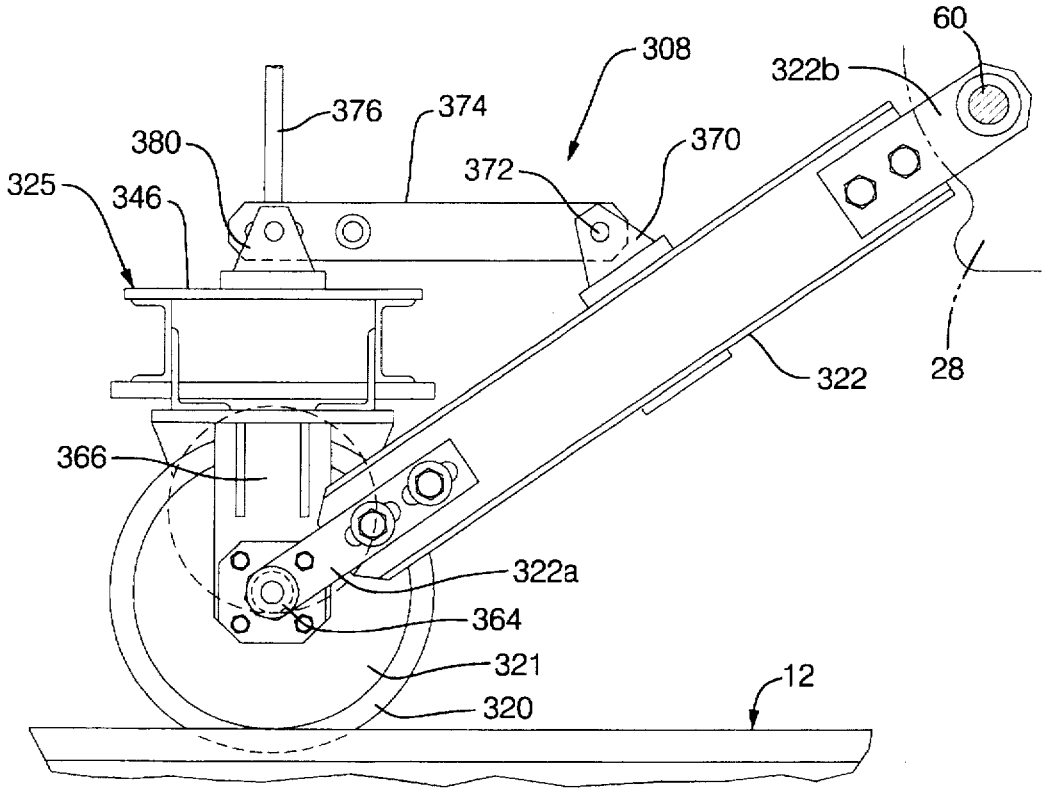
FIG. 3 is a side view of a single disc applicator assembly.

Referring to FIG. 3, an alternative slipping disc assembly is illustrated in accord with this invention for installation in the position of the assembly 8 of FIG. 1 for providing adhesion enhancement of the driven wheels 36 of the locomotive 10 of FIG. 1, but using a single disc 321 on each side of the locomotive 10 for contact with the rail 12 ahead of the forward driven wheel of the locomotive 10, such as the wheel 18 of FIG. 1. The slipping disc assembly of FIG. 3 is intended to detail the features of the slipping disc assembly provided on each side of the locomotive with only one such assembly being shown, for brevity. The assembly is illustrated in a lowered position providing for consistent contact between the disc 321 and the rail 12. The disc 321 includes interior flange 320 and is rotationally driven to provide for creep between the disc and the rail 12 through a hydraulic or electrical drive system, to be described. On substantially straight stretches of rail, the angle of attack of the disc 321 will be about zero yet beneficial creep will be induced between the powered disc 321 and the rail 12. The amount of creep may be, within limits, adjusted by varying control signals applied to the drive system, as will be described.

Disc 321 is attached to header 325 through vertical link 366 bolted to a shaft (not shown) which is fixedly attached to and rotates with disc 321. Connection head 380, such as in the form of a clevis, is secured on an upper surface 346 of the header 325 in an upward orientation with support link 374 attached thereto such as in the form of a clevis and pin joint or any rotational joint whereby the support link 374 maintains a rotational degree of freedom substantially in parallel to the rotational degree of freedom of the disc 321. The support link 374 extends to and attaches to connection point 370 which may be in the form of a clevis which is secured in an intermediate position along the lever 322, forming a rotational joint between the joint 370 and the support link 374, for example of the clevis and pin type or any conventional rotational joint providing a degree of freedom in parallel to the joint formed between support link 374 and clevis 380. Lever 322 is bolted on a first end 322*a* to the vertical link 366 with two spherical bearings (not shown) and is bolted on a second end 322*b* opposing the first end 322*a* to truck bearing adapter 28 of wheel 18 of FIG. 1. The lever is, in this embodiment, attached to the truck bearing adapter with two spherical bearings, one of which is illustrated 360, providing for a rotational joint between the second end 322*b* and the adapter 28 and providing for a rotational joint between the first end 322*a* and the vertical link 366. The assembly 308, including the disc 321 and described elements 366, 346, 374 may be bi-directionally displaced along a direction normal to the rail 12. The assembly 308 is illustrated in FIG. 3 in a lowered position for consistent contact of the disc 321 with the rail 12. However, the assembly 308 may be raised or lowered depending on operating conditions. More specifically, if rail cleaning requirements mandate a lowering of the assembly 308, for example to maintain contact between the disc 321 and the rail 12 or to increase disc pressure on the rail 12, the assembly may be lowered. Alternatively, if the operating conditions do not require treatment of the rail for increased adhesion, the assembly 308 may be raised so that no contact between the disc 321 and the rail 12 made, as may provide for increased tractive efficiency. The described slip detection system to which the valve V 42 of FIG. 1 is responsive may be used as a condition for applying the assembly 308 of FIG. 2 to the rail 12.

The mechanism for raising and lowering the assembly 308 may be any conventional actuator device, such as the pneumatic cylinder 24 (FIG. 2) of FIG. 2, which may be connected as described for the preferred embodiment of FIG. 2, whereby piston 376 if FIG. 3 is provided as a substitute for piston 76 of FIG. 2, and extends vertically from a rotational joint on header 325 offset laterally from the position of the clevis and pin joint formed between support link 374 and clevis 380 to the cylinder and having a reciprocal relationship with the cylinder 24 of FIG. 2, responsive to the control pressure applied to the cylinder, as described for the preferred embodiment. The downward contact force may be increased or decreased by adjusting the air pressure applied to the pneumatic cylinder 24 (FIG. 2).

Figure 4:
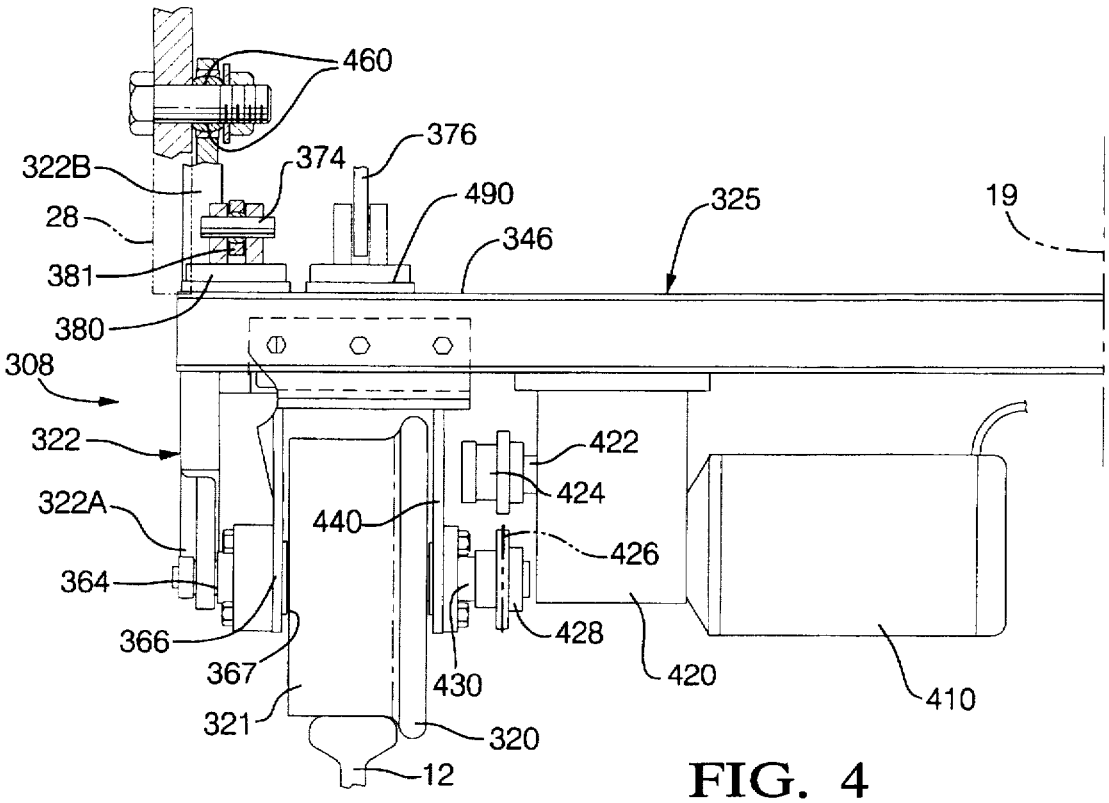
FIG. 4 is a front view of a slipping disc applicator assembly of an alternative embodiment of this invention.

Referring to FIG. 4, a front view of the slipping disc applicator of FIG. 3 is provided, with disc 321 in a lowered (engaged) position for consistent contact with rail 12. Disc 321 includes flange 320 and is attached to header 325 through vertical link 366 bolted to shaft 367 which is fixedly attached to and rotates with the disc 321. Connection point 380, such as in the form of a clevis, is secured on an upper surface 346 of the header 325 in an upward orientation with support link 374 attached thereto such as in the form of a clevis and pin joint or any common rotational joint whereby the support link 374 maintains a rotational degree of freedom substantially in parallel to the rotational degree of freedom of the disc 321. The support link 374 extends to and attaches to the connection point 370 illustrated in FIG. 3 along the lever 322, as described. Lever 322 is bolted on a first end 322*a* to a center hub 364 attached to disc 321 with a spherical bearing and is bolted on a second end 322*b* opposing the first end 322*a* through spherical bearing 460 to truck bearing adapter 28 of wheel 18 of FIG. 1. The lever 322 is, in this embodiment, attached to the truck bearing adapter 28 with spherical bearing 460 providing for a rotational joint between the second end 322*b* and the adapter 28 and allowing for rotation at the joint formed between the first end 322*a* and the vertical link 366 that operates to secure disc 321. The assembly 308 is illustrated in FIG. 3 in a lowered position for consistent contact of the disc 321 with the rail 12. However, the assembly 308 may be raised or lowered depending on operating conditions, as described.

The mechanism for raising and lowering the assembly 308 may be any conventional actuator device, such as the pneumatic cylinder 24 of FIG. 2, with a control pressure (not shown) applied thereto to extend and retract piston 376 therein, the piston rotationally coupled at a lower piston end to connection bracket 490 taking the form of a clevis in this embodiment, forming a pin and clevis joint therebetween. The connection bracket 490 is secured to the upper surface 346 of header 325.

Slip is induced in the disc 321 through a motor 410 which may take any of a variety of forms within the scope of this invention. For example, the motor 410 may be a conventional AC or DC electric motor, or may be a hydraulic gear motor (pump) providing a torque load on the disc 321. The embodiment of FIG. 4 illustrates an AC motor 410 having an output shaft (not shown) coupled to a gearset 420 of a predetermined gear ratio, such as about 20:1 in this alternative embodiment. The output shaft 422 of the gearset 420 is applied to sprocket 424 on which is mounted chain or belt 426 to rotationally drive sprocket 428 fixedly attached to shaft 430 which passes through an opening (not shown) in vertical link 440 and is secured to disc 321 to rotate therewith. Vertical link 440 is coupled to header 325. In an alternative embodiment of this invention, the AC electric motor 410, or an alternative motor within the scope of this invention such as the hydraulic gear motor may be directly coupled to the shaft 430 through axial alignment and coupling of the motor output shaft and the shaft 430.

Figure 5:
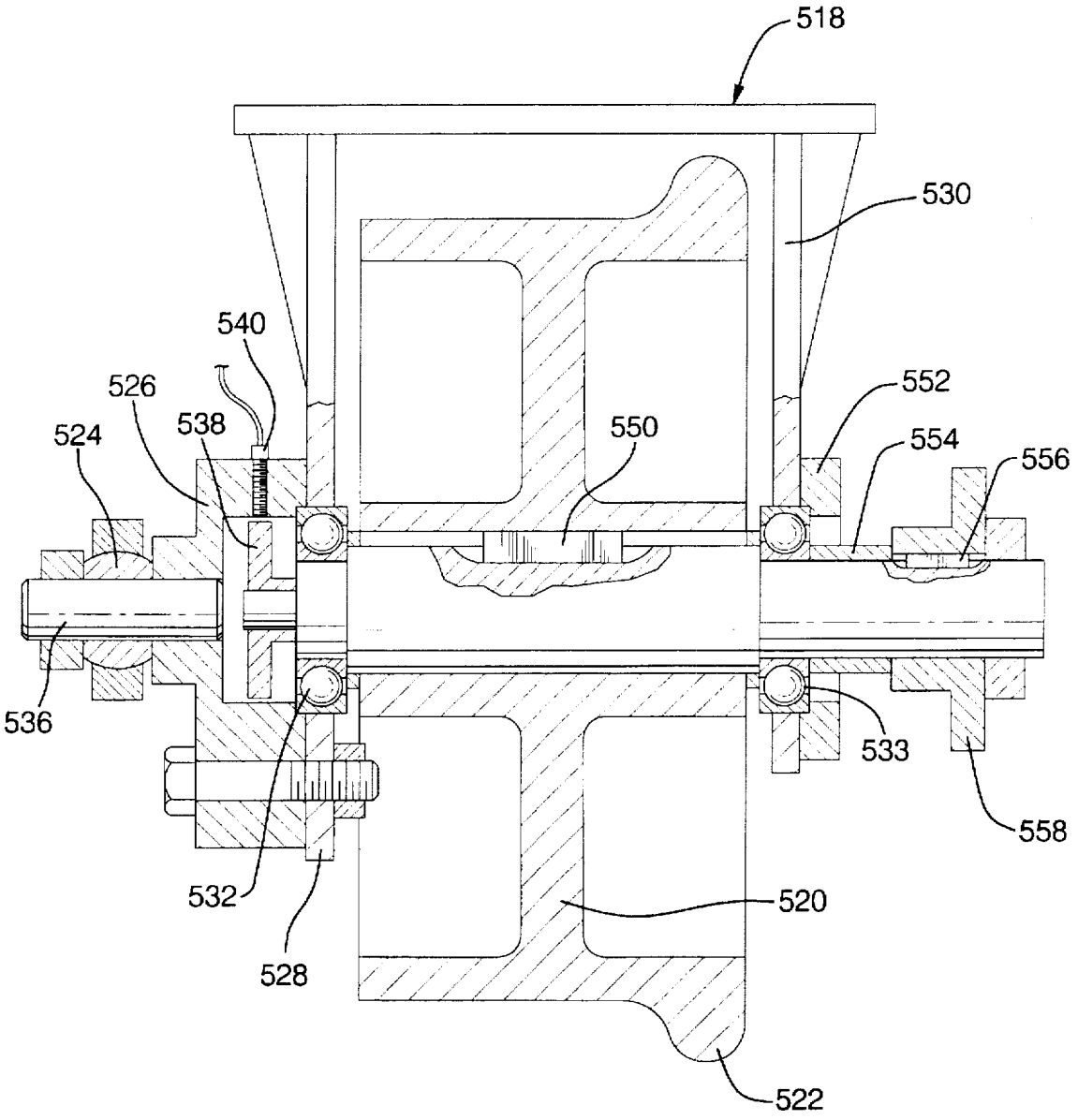
FIG. 5 is a front section drawing of one of the wheelset assemblies of FIGS. 1 and 2.

Referring to FIG. 5, a front section drawing is provided detailing further mounting features of the slipping disc 520 having flange 522, for example for application as disc 220 or 221 of FIG. 2, or as disc 321 of FIGS. 3 or 4. Wheel bracket 518 includes outer leg 528 and inner leg 530 having respective ball bearing sets 532 and 533 secured thereto for mounting shaft 560 to the legs, the shaft for supporting disc 520. The torque between the shaft 560 and the disc 520 transmitted through a key 550. Bearing stop 552, bushing 554, and key 556 hold chain sprocket 558 in secure position to rotate with shaft 560. Timing gear 538 is positioned on shaft 560 to rotate with the shaft and to pass in proximity to rotational speed sensor 540 of the variable reluctance or Hall effect type which transduces passage of the teeth or notches of the timing gear into measurable variation in transducer output signal Vout. The output signal Vout is applied for closed-loop speed control, as is generally understood by those possessing ordinary skill in the art to which this invention pertains. External stop bearing bracket 526 is secured to the leg 528 to hold pin 536 for spherical bearing (ball joint) connection 524 which is attached to lever 322 (FIG. 4).

Figure 6:
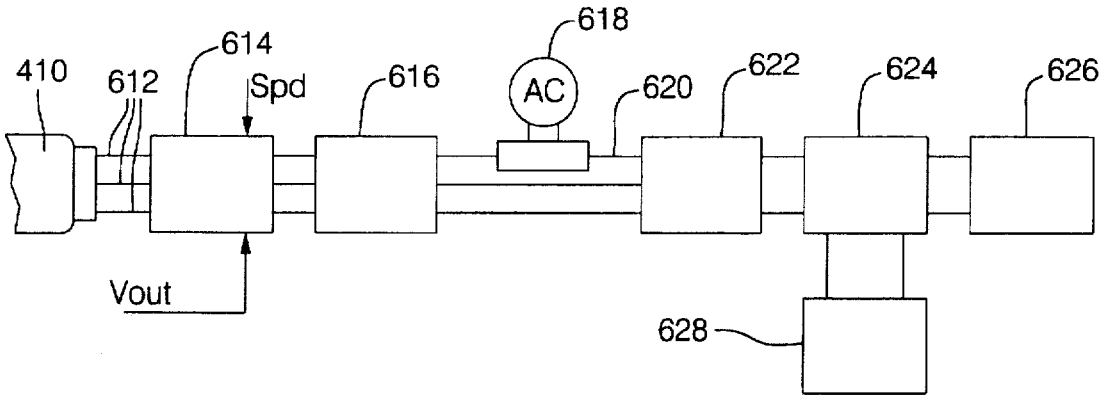
FIG. 6 is a schematic drawing of an electrically-powered or passive single disc applicator system.

Referring to FIG. 6, a schematic drawing of the electrical circuitry for driving motor 410 of FIG. 4 in either an active or a passive drive mode to induce slip or creep between the disc 321 of FIG. 4 and the rail 12 for adhesion enhancement in accord with this invention. Generally, the motor 410 is driven to resist free rotation along the rail 12 (FIG. 4). A DC electrical power supply 626, such as in the form of a 74 volt DC supply provided in the locomotive cab (not shown) provide DC current to DC contactor 624 in the form of a high current switch which, when driven to an "ON" state, passes the DC current to an inverter 622 of any standard suitable type which converts the DC current into a variable frequency three phase AC current having a phase output on line 620 for measurement by AC ammeter 618 having a current transformer. The three phase AC current is passed through a reverser AC contactor 616 and then to an AC contactor 614 including control circuitry for selectively closing the switch to pass the AC current through to the actuator 410 via current feed lines 612. Signal Vout, from the described speed transducer 540 of FIG. 5 is applied to the control circuitry of contactor 614 as a control input.

The drive circuitry of FIG. 6 provides for bidirectional control of the rotation of disc 321 which allows for selective treatment of the rail 12 (FIG. 1) depending on the rail condition for increased adhesion. First and second operating modes (DC powered modes) are provided for with electrical resistance grid and fan 628 disconnected from the electrical circuitry. A third operating mode (passive mode) is also provided with grid and fan 628 included in the circuit. In the first operating mode, positive rotational torque is applied to the disc 321 to rotate the disc in a common direction with the locomotive wheels (forward direction) with a greater rate of rotation than, for example, that of a similar undriven disc, which is termed positive slip or positive creep. Operation in the first operating mode is provided for by manually or automatically switching DC contactor 624 and AC contactor 614 to an "on" or conducting state, and manually or automatically setting the reverser 616 to rotate the AC motor 410 in the forward direction at a rotation rate exceeding that of a freely rotating disc on the rail 12 (FIG. 4).

In the second operating mode, "negative" rotational torque is applied to the disc 321, and to a corresponding disc (not shown) on the opposing side of the locomotive to either rotate the disc in a direction opposite that of the locomotive wheels, termed a reverse direction, or to rotate the disc 321 in a forward direction but with negative slip (also referred to as negative creep). Such second operating mode is provided for by operating the reverser 616 in its other state, wherein it applies a reverse torque on the AC motor 410. The amount of such torque provided by the reverser will dictate the direction of rotation of the AC motor 410 and thus that of the disc 321. The level of torque may be manually controlled by a locomotive operator, for example through manual variation of the output of motor 626.

Signal Vout indicates the rate of rotation of the disc 321. The control circuitry of the AC contactor 614 is responsive to the indicated rotational rate of the disc, whereby if the speed drops below a predetermined minimum, such as about thirty r.p.m., the AC contactor 614 is disabled. The AC contactor 614 also receives signal Spd indicating the speed of the locomotive. If the locomotive speed exceeds a predetermined threshold, such as about two m.p.h. in this embodiment, than disc protection operations are initiated in which the rotational rate of the disc, as indicated by signal Vout, is sampled. If the sampled rate is substantially zero, the AC contactor 614 will automatically be driven to an "off" or disabled state whereby the disc 321 will resume rotation. This will help maintain the geometric integrity of the disc 321.

In the third operating mode, passive AC control of actuator 410 is provided for achieving negative slip (negative creep) between the disc 321 and the rail 12 (FIG. 4). More specifically, the state of DC contactor is switched to cut the power supply 626 out of the circuit and to include an electrical resistance grid and fan 628 in the circuit. Motor 410 is backdriven through torque generated at the disc 321 rail 12 contact (FIG. 4) and acts as an electrical generator providing AC three phase current through contactors 614 and 616 to the inverter 622 which converts the AC current into a DC current applied to the resistance grid and fan 628 or any significant electrical load which includes means for an energy dissipation device. The electrical energy is converted into thermal energy via the electrical resistance or load which is dissipated by the fan. The torque load applied by the motor 410 acting as a generator to the disc 321 (FIG. 4) operates against the torque on the disc generated at the disc-rail contact, which reduces the rotational rate of the disc creating negative slip (creep) for rail treatment. Alternatively, a DC motor (not shown) having an output shaft directly coupled to disc 321 and having output terminals applied to an electrical load, such as a fan-cooled resistance grid may be provided for inducing negative slip between the rail 12 (FIG. 4) and the disc 321 (FIG. 4) in accord with this invention. A controlled excitation voltage is applied to the DC motor and is varied for varying the torque load applied to the disc 321.

Figure 7:
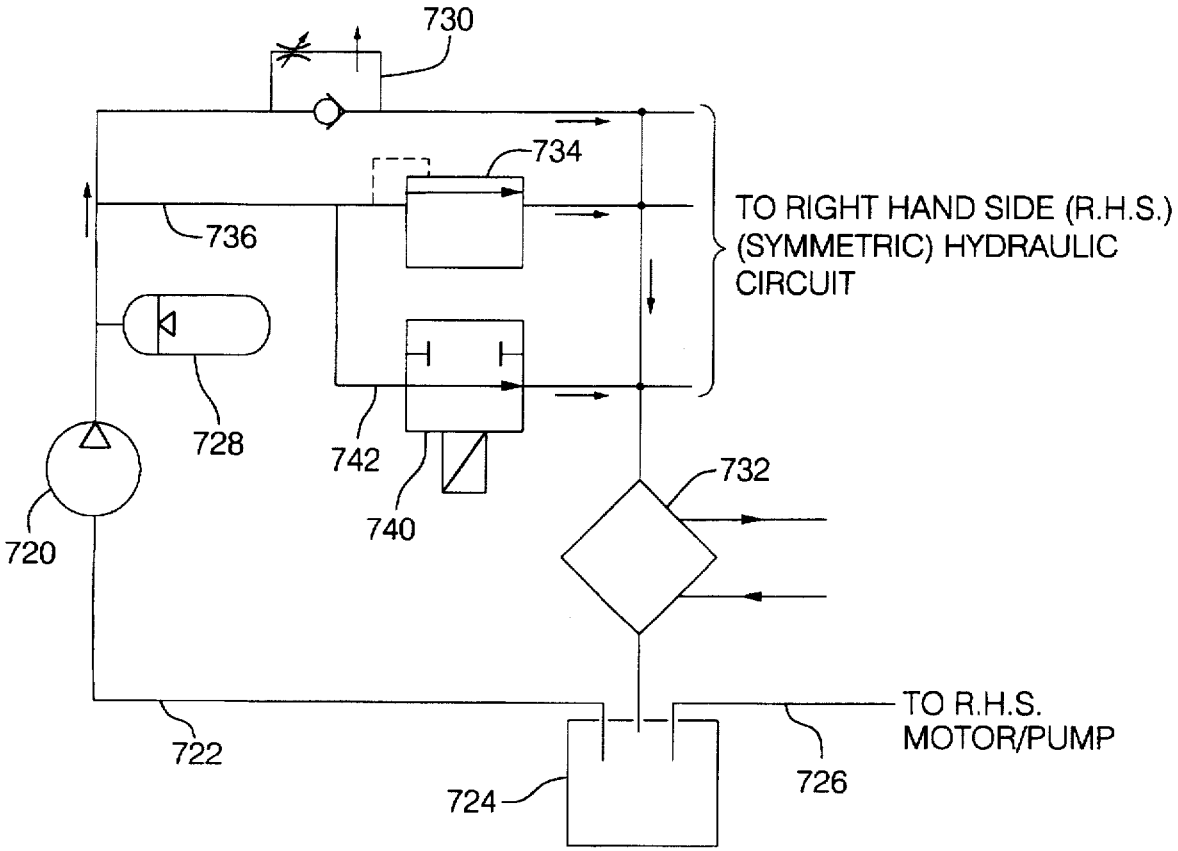
FIG. 7 is a schematic drawing of a hydraulic passive single disc applicator system.

Referring to FIG. 7, a schematic drawing of an alternative passive drive system for inducing slip between the disc 321 of FIG., 4 and the rail 12 (FIG. 4) through hydro-mechanical load applied to the disc 321 through a hydraulic gear motor 720 with an output shaft directly coupled to the shaft 430 of FIG. 4 as described for FIG. 4. The hydraulic gear motor 720 functions as a hydraulic pump providing for a hydro-mechanical load transfer to the disc 321 of FIG. 4. Rotation of the pump 720, which is backdriven by the rotating disc 321, draws hydraulic fluid (not shown) out of reservoir 724 through hydraulic line 722 at pressure. Accumulator 728, containing a pressurized bladder absorbs and dissipates any significant time rate of change in hydraulic pressure along the line 722. The fluid is driven to flow control valve 730, across the valve and through heat exchanger 732 and back to the reservoir 724. Control of the opening of the flow control valve will vary restriction to flow of the fluid through line 722, allowing for variation in hydro-mechanical load on the pump 720, transferred to the disc 321. Excessive pressure build-up in line 722 is relieved through pressure relief valve 734 in fluid line 736 in parallel to valve 730. Above a predetermined pressure, the relief valve 734 will bleed fluid back to reservoir 724 to ensure the degree of slip between the disc 321 and rail 12 (FIG. 4) is not excessive. If free rotation (no slip) of the disc 321 is desired, a direction control valve 740 in a hydraulic line parallel to the relief valve 734 is opened, either manually or automatically, and fluid is dumped back to the reservoir 724 to quickly relieve pressure of the fluid to reduce the hydro-mechanical load on the disc 321. Alternatively, negative slip may be developed through an embodiment of this invention including an electromagnetic spring-actuated drum or disc brake device of any conventional type substituted directly for the hydraulic motor through direct coupling to the shaft 430 of FIG. 4. When engaged, such brake device would retard the rate of rotation of the disc 321 below an unloaded rate of rotation. The engagement force is then controlled to vary the degree of slip between the rail 12 and disc 321 of FIG. 4.

The preferred embodiment is not intended to limit or restrict the invention since many modifications may be made through the exercise of ordinary skill in the art without departing from the scope of the invention.

The embodiments of the invention in which a property or privilege is claimed are described as follows:

1. A slipping disc apparatus secured to a locomotive for treating a rail surface to increase adhesion between driven wheels of the locomotive and the rail surface, comprising:

a circular disc;

an additional circular disc, wherein the first-recited and the additional circular disc form a pair of discs;

a positioning assembly coupled to the pair of discs for positioning the pair of discs in contact with the rail surface; and a disc drive mechanism comprising a passive coupling between the pair of discs for coupling the rate of rotation of each of the pair of discs, providing for a significantly different rate of rotation between the pair of discs while the pair of discs are in contact with the rail surface.

2. The apparatus of claim 1, wherein the passive coupling further comprises:

a first sprocket secured to the first-recited circular disc for rotating therewith;

a second sprocket secured to the additional circular disc for rotating therewith, the second sprocket having a diameter substantially greater than the diameter of the first sprocket; and a chain substantially in tension between first and second sprockets for rotating the first and second discs at significantly different rates of rotation while the pair of discs are in contact with the rail surface.

3. A slipping disc apparatus secured to a locomotive for treating a rail surface to increase adhesion between driven wheels of the locomotive and the rail surface, comprising:

a circular disc;

a positioning assembly coupled to the circular disc for positioning the circular disc in contact with the rail surface; and a disc drive mechanism comprising a passive hydraulic motor with an output shaft mechanically linked to the circular disc whereby a load is applied to the circular disc to reduce the rate of rotation of the circular disc when the circular disc is in contact with the rail surface to induce creep between the rail surface and the circular disc for treating the rail surface.

4. An apparatus suspended from a locomotive for cleaning a rail surface to reduce slip between driven wheels of the locomotive and the rail surface, comprising:

a rotatable disc having an outer circumferential face;

a second rotatable disc having an outer circumferential face and aligned with the first-recited rotatable disc forming a pair of aligned discs;

a suspension assembly secured to the pair of aligned discs for securing the pair of aligned discs to the locomotive, the suspension assembly including a positioning mechanism for positioning the pair of aligned discs over the rail surface whereby the outer circumferential face of each of the pair of aligned discs contacts the rail surface; and a drive mechanism comprising a belt mechanically linked to each of the pair of discs to couple rotation of the first-recited rotatable disc with rotation of the second rotatable disc in such a manner that while the pair of discs are rotating, the rate of rotation of the first-recited rotatable disc will be substantially different than that of the second rotatable disc.

5. An apparatus suspended from a locomotive for cleaning a rail surface to reduce slip between driven wheels of the locomotive and the rail surface, comprising:

a rotatable disc having an outer circumferential face;

a suspension assembly secured to the disc and to the locomotive for securing the disc to the locomotive, the suspension assembly including a positioning mechanism for positioning the rotatable disc over the rail surface whereby the outer circumferential face contacts the rail surface; and a drive mechanism comprising a passive hydraulic motor having an output shaft mechanically linked to the rotatable disc to selectively apply a load to the rotatable disc to vary the rate of rotation of the rotatable disc in a direction to induce creep between the outer circumferential face of the rotatable disc and the rail surface.

* * * * *